US007958567B2

(12) United States Patent
Sutter et al.

(10) Patent No.: US 7,958,567 B2
(45) Date of Patent: Jun. 14, 2011

(54) LOW PROTRUSION SAFETY FASTENER FOR BALLISTIC HELMET

(75) Inventors: Brad Sutter, Exeter, PA (US); Charles F. Acker, Equinunk, PA (US); David Burke, Carbondale, PA (US)

(73) Assignee: Gentex Corporation, Carbondale, PA (US)

( * ) Notice: Subject to any disclaimer, the term of this patent is extended or adjusted under 35 U.S.C. 154(b) by 1537 days.

(21) Appl. No.: 11/207,469

(22) Filed: Aug. 19, 2005

(65) Prior Publication Data

US 2008/0000015 A1 Jan. 3, 2008

(51) Int. Cl.
*A42B 3/00* (2006.01)

(52) U.S. Cl. ..... 2/6.2; 2/410

(58) Field of Classification Search ..... 2/6.2, 416, 2/421, 422; 411/2, 3, 5
See application file for complete search history.

(56) References Cited

U.S. PATENT DOCUMENTS

| | | | | | |
|---|---|---|---|---|---|
| 3,512,447 | A * | 5/1970 | Vaughn | 411/5 |
| 4,370,759 | A * | 2/1983 | Zide | 2/424 |
| 4,544,312 | A * | 10/1985 | Stencel | 411/3 |
| 5,121,508 | A * | 6/1992 | Grilliot et al. | 2/421 |
| 5,333,329 | A * | 8/1994 | Hong | 2/424 |
| 5,600,084 | A | 2/1997 | Gonzalez | |
| 5,978,973 | A * | 11/1999 | Chartrand | 2/422 |
| 6,260,197 | B1 * | 7/2001 | Hoogewind | 2/8.3 |
| 6,711,751 | B1 * | 3/2004 | Muskovitz | 2/410 |
| 6,772,447 | B2 * | 8/2004 | Morrow et al. | 2/424 |
| 6,854,921 | B2 | 2/2005 | Melberg et al. | |
| 2003/0104738 | A1 | 6/2003 | Porter | |
| 2004/0058125 | A1 | 3/2004 | Gonzalez | |
| 2005/0022658 | A1 | 2/2005 | Bateman et al. | |

* cited by examiner

*Primary Examiner* — Shaun R Hurley
*Assistant Examiner* — Andrew W Sutton
(74) *Attorney, Agent, or Firm* — Design IP

(57) ABSTRACT

A safety fastener for mounting fitting equipment such as suspension and retention systems onto a ballistic helmet. The nut portion of the fastener fits substantially within a grommet that is attached to a strap that forms part of the suspension or retention systems. The nut retains, rather than clamps, the grommet to the helmet. The grommet can be pulled off the nut. The pull-out force is less than the fastener fracture force. The configuration of the fastener allows ballistic threat energy to be absorbed by helmet deformation and delamination along with grommet pull-out to provide energy dissipation in stages which avoids the creation of secondary projectiles from the fastener itself.

18 Claims, 3 Drawing Sheets

LOW PROTRUSION SAFETY FASTENER FOR BALLISTIC HELMET

BACKGROUND OF THE INVENTION

1. Technical Field

The present invention relates generally to safety fasteners for ballistic resistant helmets. More particularly, it encompasses fasteners designed to reduce the likelihood of secondary projectiles forming due to a nearby ballistic incursion.

2. Description of Prior Art

Ballistic helmets, primarily for military use, are capable of resisting ballistic threats through the design and manufacture of the helmet shell. One approach involves several layers of composite materials that are impregnated with resin and laminated together under pressure and heat. For example, layers of Kevlar® fabric may be impregnated with a thermoset resin that is molded to form the helmet shell. Steel helmet shells constitute another approach.

In order to adequately protect the wearer, helmets must remain strapped on through the use of various suspension, retention and chinstrap fitting equipment. Mounting of fitting equipment to the helmet shell requires bolting to bores formed in the helmet shell. The creation of these bores, and the external exposure of the bolt heads, compromises the ballistic safety of the helmet shell. In particular, instances of ballistic incursion in the vicinity of this mounting hardware presents an elevated threat, in the form of secondary projectiles. If the fastener fails, secondary projectiles may be created within the helmet shell or exterior to the helmet shell.

U.S. Pat. No. 6,854,921 discloses a ballistic resistant cap nut for use with a conventional screw bolt for securing the flight deck door frame on a commercial airliner. The cap nut achieves its ballistic resistance by employing titanium or stainless steel in an overdimensioned configuration to provide greater robustness. Such an approach would be unacceptable in a helmet environment due to the increased weight and excessive internal protrusion.

U.S. Pat. No. 5,600,084 discloses a conventional armor plate bolt fastener that captures a ballistic material web. The web is wrapped around the bolt head to secure a thin shield therein. The web and shield would be too heavy and provide too great an external protrusion for a helmet.

U.S. Patent Applications 2004/0058125 and 2005/0022658 utilize conventional screw and bolt fasteners to add layers of ballistic resistant panels to protect underlying structures. U.S. Patent Application 2003/0104738 discloses a multi-layered composite laminate, wherein various layers have different mechanical properties to improve shearout resistance along with better distribution of cutting and impact forces.

Accordingly, it would be desirable to provide a safety fastener that is lightweight, meets tighter standards for internal protrusion and minimizes the deleterious effects associated with forming mounting bores though the helmet shell.

SUMMARY OF THE INVENTION

It is an object of the present invention to provide a fastener which can safely mount fitting equipment to a protective helmet.

It is another object of the present invention to meet stricter guidelines for inside-the-helmet protrusion limits and corresponding weight limits.

It is a further object to provide a fastener which improves the likelihood that the helmet can absorb a ballistic threat without the formation of secondary projectiles.

These and other related objects are achieved according to the present invention by a safety connector for mounting fitting equipment to a protective helmet shell and resisting fracture during nearby ballistic incursion. The safety connector is a fastener having a low, interior impact profile which facilitates the absorption of ballistic threat energy by the helmet shell. The absorption of ballistic threat energy by the helmet shell prevents the fastener from forming a secondary projectile. The fastener is adapted to disengage from the fitting equipment without fracturing. The fastener disengagement prevents the fastener from forming a secondary projectile. The absorption of ballistic threat energy by the helmet shell works in combination with the fastener disengagement, depending on the nature, angle of incidence and momentum of the ballistic incursion, to prevent the fastener from forming a secondary projectile.

The fastener includes an engagement surface for contacting the fitting equipment on an inner side. The engagement surface is shaped and configured to retain the fitting equipment up to a preset pullout force, which is less than the fastener fracture force. The engagement surface is ramped to allow for progressive deformation and energy dissipation of the fitting equipment. The fitting equipment has a strap bearing a grommet, and wherein the smaller end of the ramped surface fits within the grommet. The ramped surface is conical. The fastener includes a threaded body along its central core which carries the exterior-facing engagement surface.

The fastener comprises a screw that extends through a bore formed through the helmet shell and includes mating threads to engage the threaded body without exceeding pre-set limits on in-the-helmet protrusion. The screw includes a head with an increased diameter that contacts the exterior of the helmet shell over an enlarged surface area. The screw includes a non-threaded shank portion adapted for placement within the helmet bore. The shank has a cross-sectional surface area "a" and the head has a cross-sectional area "A">4a. The head contacts a greater surface of the shell thereby increasing the transfer of any ballistic energy to said head on to the shell. The screw includes a fillet portion at the juncture of said head and said shank that increases the screw's resistance to fracture. The shank has a diameter "d" and said fillet has a radius "f", in which $0.1d<f<0.2d$. The threaded body is dimensioned larger than the bore, so that following fitting equipment disengagement, the fastener is retained from exiting the shell. The threaded body and said mating threads are substantially disposed concentrically within a grommet of the fitting equipment.

In an alternate description, the invention relates to a ballistic resistant safety fastener for mounting a grommet to a protective helmet shell that utilizes helmet shell deformation along with a grommet pull-out force to avoid creation of secondary projectiles. The fastener includes a screw component and a nut component. The screw extends through the helmet and terminates near the interior face of the grommet. The nut includes a lip portion to retain the grommet up to the pull-out force which is less than the fastener fracture force. The nut includes a sleeve portion disposed concentrically between the screw and the grommet. The lip portion flares outwardly from the sleeve portion.

The screw includes a non-threaded shank that extends through the helmet. The screw includes machine threads at its terminal end, and wherein the screw has a zero in-the-helmet protrusion beyond the grommet. The shank has a greater diameter than the thread crest. The lip portion flare has a conic shape. At least part of the lip portion extends slightly past the terminal end of the screw. At least part of the lip portion extends slightly past the interior face of the grommet. The lip portion that extends beyond the screw is adapted to receive a tool. The flare allows for progressive deformation and energy dissipation as the grommet eye opens under influence of the pull-out force. The lip portion flare is larger than the screw-receiving bore formed within the helmet shell. Where following pull-out of the grommet, the size of the lip portion flare prevents the fastener from outwardly exiting the helmet.

The screw includes a head with an increased diameter that contacts the exterior of the helmet shell over an enlarged surface area. The screw includes a non-threaded shank portion adapted for placement within the helmet bore and wherein the shank has a cross-sectional surface area "a" and the head has a cross-sectional area "A">4a. The head contacts a greater surface of the shell thereby increasing the transfer of any ballistic energy to the head on to the shell. The said screw includes a fillet portion at the juncture of the head and the shank that increases the screw's resistance to fracture. The shank has a diameter "d" and said fillet has a radius "f", in which 0.1d<f<0.2d.

These and other aspects, features and advantages of the present invention will be described or become apparent from the following detailed description of the preferred embodiments, which is to be read in connection with the accompanying drawings.

BRIEF DESCRIPTION OF THE DRAWINGS

The advantages, nature and various additional features of the invention will appear more fully upon consideration of the illustrative embodiments now to be described in detail in connection with the accompanying drawings. In the drawings wherein like reference numerals denote similar components throughout the views.

It should be understood that the drawings are for purposes of illustrating the concepts of the invention and are not necessarily the only possible configuration for illustrating the invention.

DETAILED DESCRIPTION OF PREFERRED EMBODIMENTS

In ballistic helmet design, one approach is to create the helmet shell out of layers of composite material, laminated together. Ideally, this structure would present the maximum protection if it were to remain complete and unpierced. But to make the helmet usable, hole must be made in the shell to attach suspension, retention and chinstrap components. Part of this mounting hardware will be on the outside of the helmet and subject to the threat projectiles. In general, reference will be made in this document to "fitting equipment" that includes the suspension, retention and chinstrap components. However, it is also intended that the phrase "fitting equipment" should encompass any part that may be mounted to a helmet.

A composite is a material having two or more distinct components. Typically ballistic composites include a reinforcing component like carbon, graphite, boron or aramid fibers, such as KEVLAR®. The reinforcing component is combined with a thermoplastic or thermoset resin to form a prepeg or lay-up layer. Multiple layers are joined together under pressure and heat to form a laminate. Other varieties of protective helmets are made from steel. The fastener according to the invention may be employed with any type of helmet that has fitting equipment mounted thereto.

There are two different types of ballistic trauma caused by a projectile when impacting this mounting hardware. References to "projectile" include bullets, shrapnel or other objects capable of contacting the helmet. One type is a direct hit to a screw head. The other type is a glancing hit to the screw head or near miss where the screw head is pushed laterally and the composite is deformed by the projectile. In this instance, the mounting hardware can be fractured and cause the formation of a secondary projectile. The secondary projectile, being inside the helmet shell and still possessing ballistic impact energy, may impact and cause damage to the user's head.

Figure 1:
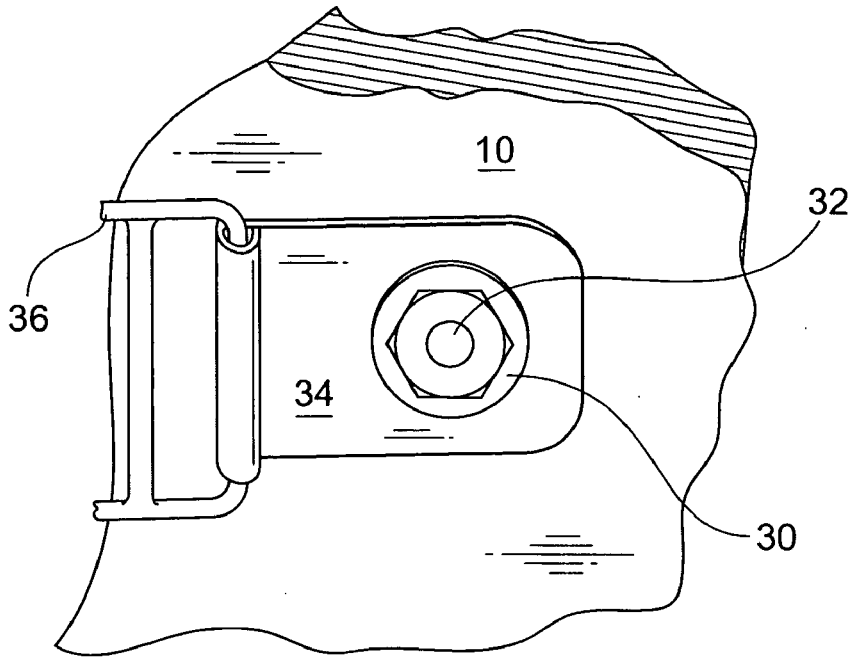
FIG. 1 Prior Art
FIG. 1 is a top plan view of a bracket bolted to the interior of a protective helmet according to the prior art.
Figure 2:
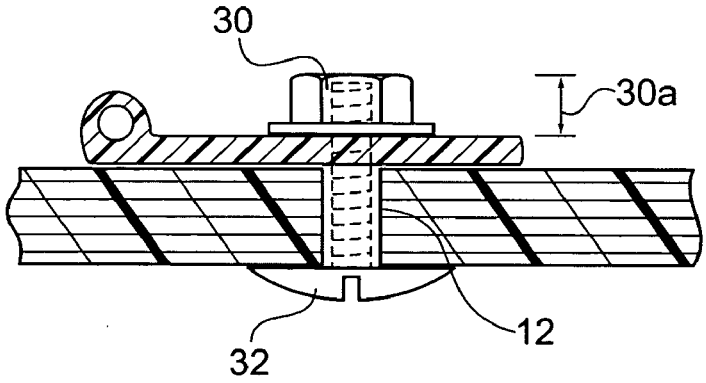
FIG. 2 Prior Art
FIG. 2 is a partial cross-sectional view of the bolted connection according to the prior art.
Figure 3:
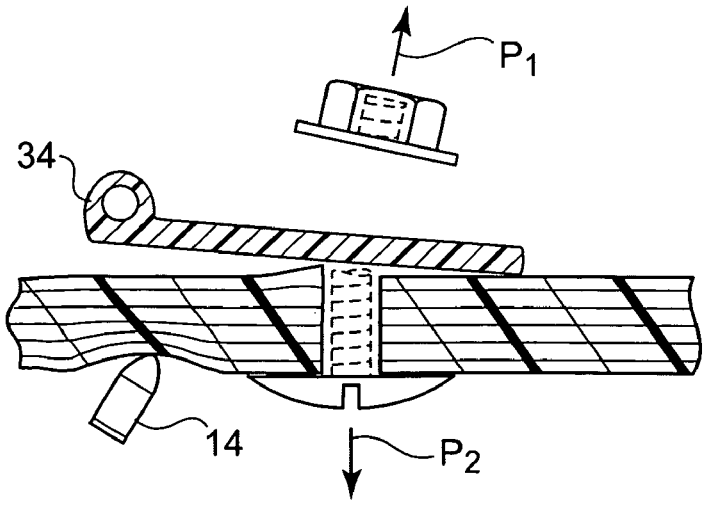
FIG. 3 Prior Art
FIG. 3 is a similar cross-sectional view showing the prior art bolt fracturing as a result of ballistic incursion.

Referring now in detail to the drawings, and in particular FIGS. 1, 2 and 3, there is shown a prior art fastener consisting of nut 30 and screw 32 passing through a bore 12 formed through helmet 10. The fastener mounts a bracket 34 to the interior of helmet 10. A buckle 36 is pivotally retained by bracket 34, and is suited to engage a strap. FIG. 2 shows the height of the assembly inside the mounted equipment as represented by arrow 30*a*. This height may be in the range of ¼ inch. Previously, to improve the fastener's resistance to fracture, larger and more robust nuts and screws were utilized. As the bolt dimensions increase, there is a greater likelihood of exceeding the in-the-helmet protrusion limits, which are considerably less than the ¼ inch illustrative example.

FIG. 3 shows a projectile incursion, in the form of a bullet 14. The figure shows a type two non-direct hit, where the projectile impacts near bore 12. Projectile contact is a violent explosive event, as the kinetic energy of the projectile is transferred into the laminate of helmet 10. The composite will likely deform in shape and may experience various degrees of delamination. The major drawback of the prior art fastener is that it operates on a principle of clamping the planar surface bracket to the helmet by the broad skirt of the nut. The deformation energy and/or delamination forces build up until they reach the fracture threshold of the fastener. Here nut 30 becomes a secondary projectile $P_1$ within the helmet. In addition, the deformation or delamination may expel screw 32 as a further secondary projectile $P_2$ out of the helmet. Pieces of the nut or bolt may become secondary projectiles also.

The prior art technology does not consistently stop a ballistic threat and results in secondary projectiles penetrating the witness plate when tested against 9 mm 124 grain FMJ threats. The prior art does not provide sufficient ballistic threat protection as secondary projectiles occasionally result from fastener failure during testing. Prior art technology depends on increasing the size (and thereby the strength) of the fastener. The larger fasteners may exceed the inside-the-shell protrusion requirements. In addition, larger nuts provide a greater surface area on which to receive impact energy, which increases strain and leverage applied to the screw. Prior art technology does not enlist the ballistic shell composite structure itself to absorb a portion of the impact energy, reducing the strength requirements (and thus) size of the fastener hardware yet consistently demonstrating no penetration of the witness plate during ballistic testing.

Figure 4:
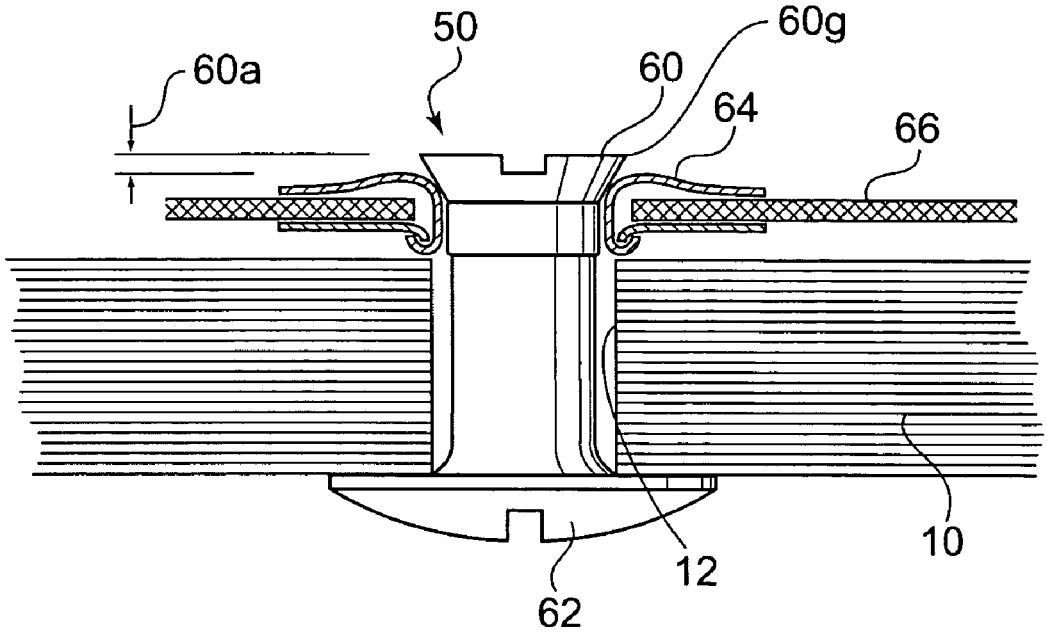
FIG. 4 is a partial cross-sectional view of a safety fastener according to an embodiment of the invention.
Figure 5:
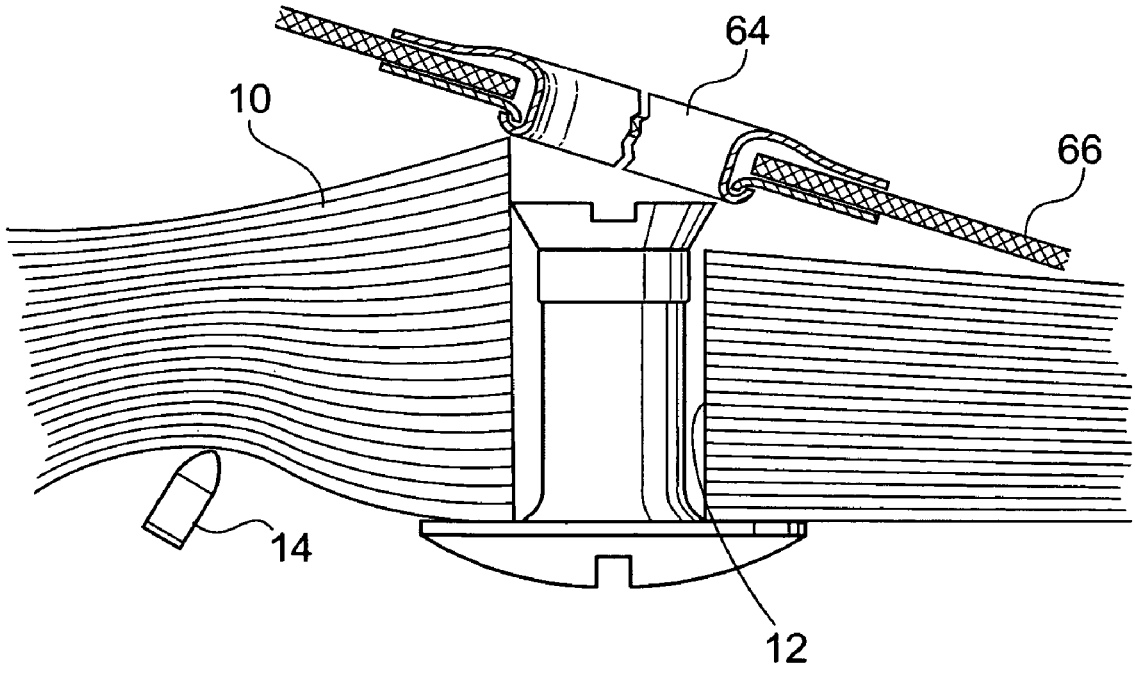
FIG. 5 is a similar cross-sectional view showing the intact safety fastener following ballistic incursion.

FIGS. 4 and 5 illustrate the installed safety fastener 50 according to an embodiment of the invention. Safety screw 62 passes through an appropriately sized bore 12 through helmet 10. Bore 12 has a diameter "B". A strap 66 equipped with a grommet 64 is retained, not clamped, to the interior of helmet 10 by safety nut 60. The height of safety nut 60, represented by arrow 60*a* is only slightly higher than the grommet, thereby meeting the inside-the-helmet protrusion requirements. Additional details of the safety nut 60 and the safety screw 62 will be provided below.

To defeat a glancing hit, as shown in FIG. 5, the resulting transient deformation must be overcome in a way that avoids failure of the safety fastener 50. According to the invention, the energy absorbing capability of the composite itself is enlisted to achieve this. Limits have been placed on both the amount of inside-the-helmet protrusion (vertical height) and size (diameter) of the mounting hardware. In this embodiment, safety nut 60 is conically shaped to fit substantially within the grommet. Safety nut 60 has a major diameter "D" and a minor diameter "d". The grommet is installed onto a strap that may be part of the suspension, retention or chinstrap componentry. The installed grommet has an inside diameter "G". If the energy contained within the glancing hit is great enough, the composite adjacent to the hit delaminates forcing the grommet inside diameter to expand to the point where the grommet can slip over the major diameter "D" of the conical nut. As the grommet slippage takes place, any additional delamination of the composite will brush past the conical nut so that failure of the safety fastener 50 is avoided and no secondary projectiles are formed that could reach and penetrate the witness plate. The following relationships exist

| | |
|---|---|
| D > G; | D > B; |
| d < G; | d < B; |
| d < G < D; | d < B < D; |

and can be applied to a wide variety of fastener configurations.

Several key features of the invention are as follows. Safety nut 60 does not possess a clamping surface that faces the inside of the helmet. Therefore, it is dimensioned and oriented to provide adequate space for the composite to deform or expand without interference, even at the very edge of the bore. Composite deformation or delamination may also cause displacement of the strap or grommet. The strap is free to move or bend the outer flange or flanges of the grommet. Energy acting upon the grommet will gradually force it up the conical surface. The grommet will progressively stretch or break as it rides up, causing a dissipation of energy in the process. Even if the grommet cracks, its separate piece(s) will remain clipped to the strap. Once released from the grommet, the safety nut will catch onto the edges of the delaminating composite. Accordingly, the formation of secondary projectiles will be avoided.

The safety fastener was tested against ballistic penetration using a 9 mm 124 grain FMJ bullet, tested in accordance with NIJ Level IIIA 9 mm threat. Surprisingly, the safety fastener employs smaller, lighter weight materials to achieve a higher ballistics rating than any known prior art fastener. The invention is well suited for ground troop ballistic helmets that face a ballistic threat and require the attachment of fitting equipment. However, the key concept developed herein is that of retaining fitting equipment rather than clamping. The retention is carefully engineered to allow fitting equipment pull-out well before fastener failure. This concept can be applied to a wide variety of connection elements other than grommets. For example, brackets or plates with conic shaped holes or other types of apertures, slots, etc. In general, we refer to the application of this concept as providing a fastener with a low, interior impact profile.

We define "low, interior impact profile" according to location, structure and performance as follows. Location wise, this means a portion of the fastener that resides interior of the helmet shell. Structurally, the interior portion of the fastener is shaped and configured to avoid interfering with the protective nature of the helmet shell, that is, to absorb ballistic threat energy in the vicinity of the fastener. By allowing the shell to absorb a greater proportion of ballistic energy, the fastener realizes improved performance in its function of safely securing the fitting equipment and reducing the risk of creating secondary projectiles.

Figure 6A:
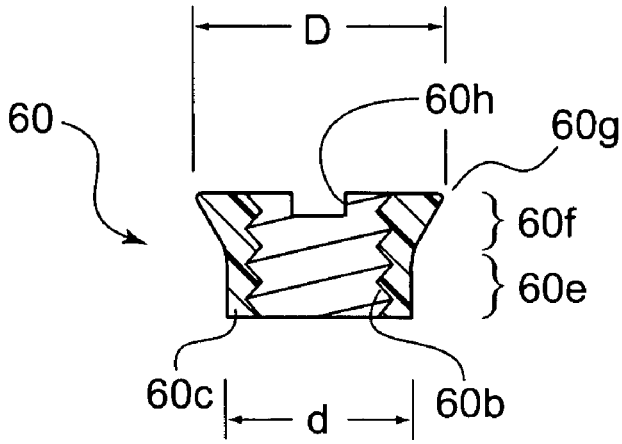
FIG. 6A is a cross sectional view of the nut according to an embodiment of the invention.

FIG. 6A shows safety nut 60 with a standard female machine screw thread 60*b*. A bottom edge 60*c* resides facing shank edge 62*c*, and may overhang the shank 62*d* slightly (as shown in FIG. 4). The lower extent is fashioned as a cylindrical portion 60*e*. The upper extent is fashioned as a conical portion 60*f*. The cylinder dimensions along with the lower cone dimensions and angle are designed slightly smaller than the grommet opening to fit neatly therein. Conical portion 60*f* provides a ramp for the progressive deformation and corresponding progressive energy dissipation of the grommet. Conical portion 60*f* is also described as including a lip portion 60*g*, or engagement surface, to retain the grommet up to the pull-out force which is less than the fastener fracture force. These structures which omit horizontal surfaces facing the inner helmet and which functionally avoid interference with deformation and delamination, comprise our low, interior impact profile. As a non-limiting example, for 10-32 machine threads 60*b*, cylindrical portion may have a diameter of 0.20-0.30 inches. The conical portions and flares out to a maximum diameter of 0.25-0.30 inches. The height of portions 60*e* and 60*f* may each be less than 0.10 inches. A radius of lip portion 60*g* may be 10 to 15% of the cylinder diameter. A slot 60*h* may receive a flat blade screwdriver. Even in the fully tightened position, slot 60*h* clears the end of the screw. Many other dimensions may be employed within the context of the invention.

Figure 6B:
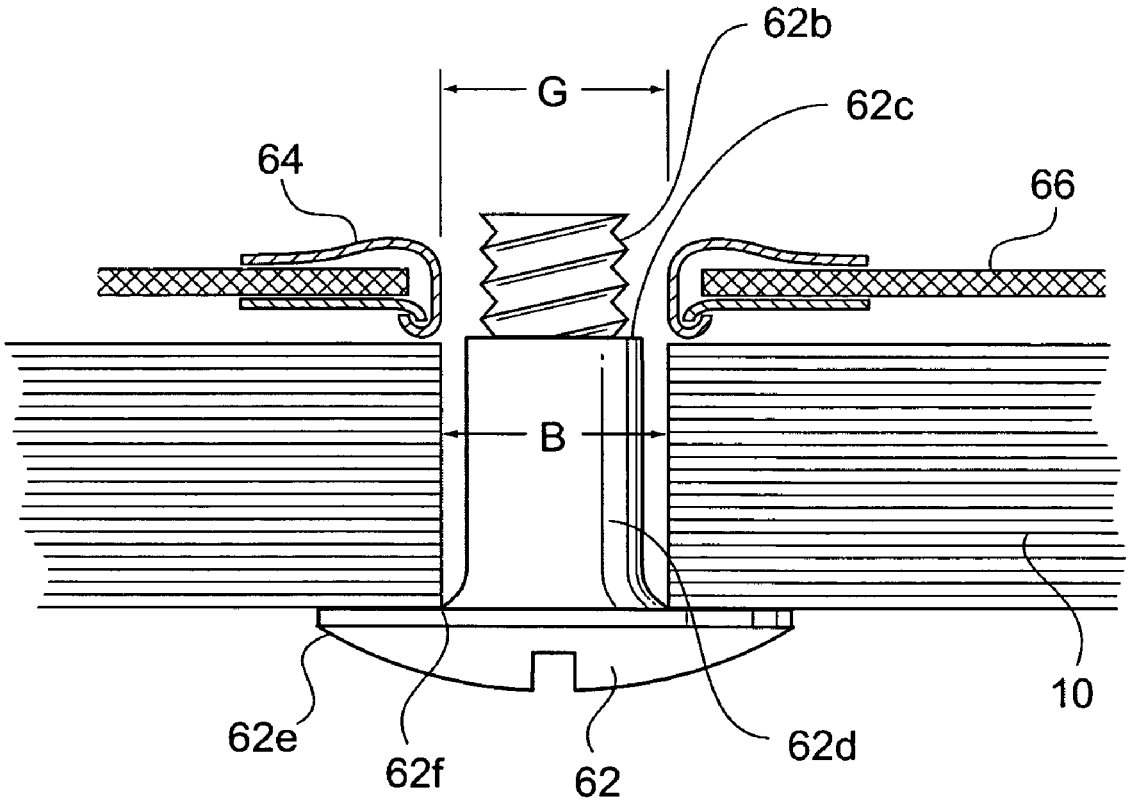
FIG. 6B is a partial cross sectional view of the screw according to an embodiment of the invention.

Turning now to safety screw 62 of FIG. 6B, there is provided mating male machine threads 62*b* and a non-threaded shank 62*d*. The shank plus thread length is adjusted just short of the helmet-grommet thickness, typically between 0.50 and 0.60 inches. In this embodiment, the diameter at the thread crest is less than the diameter of shank 62*d*. This provides a robust transition to head 62*e* via fillet 62*f*. In the illustrated embodiment, head 62*e* is a button head or dome head characterized by a cylindrical portion capped with a dome. This style head provides a large underside surface area and a low height. The radius of fillet 62*f* may be between 10 and 20% of the shank diameter. If contacted by a ballistic threat, head 62*e* is able to transmit impact energy effectively to the helmet shell over its large surface area without fracturing. The fillet 62*f* and robust shank 62*d* provide further resistance to shearing, i.e. having the head shear off the shank. Fillet 62*f* also provides a smooth, rounded transition between perpendicular surfaces to minimize damage and tearing to the adjacent composite, if the screw if driven laterally by ballistic incursion. Similarly, both sets of threads 60*b* and 62*b* are completely mated to avoid undesirable interactions with the laminate or fitting equipment. The close fitting relationship between safety nut 60 and grommet 64 provides superior resistance to laterally directed forces, while still providing the built-in release feature.

For laminated helmets, there is provided a screw-bolt and nut fastener that safely dissipates energy directed at the screw-bolt when the fastener is used to mount grommetted fitting equipment to a protective helmet. The screw-bolt passes through a closely tailored bore formed through the layers of the protective helmet. A low intrusion nut having a Y-shaped cross sectional shape that fits substantially within the grommet is threaded onto the screw-bolt to retain the fitting equipment adjacent the helmet shell. Ballistic energy directed at the screw-bolt is primarily transferred via the screw head to said helmet causing said layers to absorptively delaminate. Further energy is dissipated as the delaminating layers force the fitting equipment away from the head causing the grommet to expand. Additional energy would cause the grommet to shear open and slip over the major diameter of the safety nut. The energy required to force the grommet off the safety nut is less than the fracture threshold of the fastener. As can be seen, the safety fastener represents an improvement over prior art approaches in that it has been reduced in weight and size. The head diameter, shank and fillet are proportionally larger and more robust. The low, interior impact profile, allows the fastener to interact more flexibly, thereby giving the shell greater latitude as it undergoes its transient deformation upon impact. The flexibility arises from the newly designed retaining lip, which overcomes the major problem of fastener failure resulting from the explosive release arising when equipment is clamped to the shell.

Although illustrative embodiments of the present invention have been described herein, it is to be understood that the present invention is not limited to those precise embodiments, and that various other changes and modifications may be affected therein by one skilled in the art without departing from the scope or spirit of the present invention. All such changes and modifications are intended to be included within the scope of the invention as defined by the appended claims. For example, it is expressly intended that alternated designs, dimensions and relationships between portions of the safety fastener which perform substantially the same function in substantially the same way to achieve the same results are within the scope of the invention. Moreover, it should be recognized that any disclosed form or embodiment of the invention may be incorporated in any other disclosed or described or suggested form or as a general matter of compatibility of application method. It is the intention, therefore, to be limited only as indicated by the scope of the claims appended hereto.

What is claimed is:

1. An apparatus for mounting fitting equipment to a protective helmet shell having an interior, an exterior, and a bore extending through the helmet shell between the interior and the exterior, the fitting equipment having an opening, the apparatus comprising:

a fastener comprising:

a screw having:

a head at a first end thereof, a second end opposing the first end, and a shank portion which is adapted to extend through the bore, the bore having a diameter B; and a nut having a lip portion, the nut being connected to the screw at the second end thereof, the nut having a first portion having a diameter D and a second portion having a diameter d, the second portion being located between the first portion and the first end of the screw; and a grommet connected to the fitting equipment, the grommet having an inner diameter G, the grommet being inserted into the opening in the fitting equipment, the opening having a diameter larger than the diameter G, such that a gap is formed between the inner diameter of the grommet and the opening in the fitting equipment, wherein energy acting upon the grommet forces the grommet up the lip portion, dissipating the energy, wherein diameter D>inner diameter G>diameter d; and wherein diameter D>diameter B>diameter d.

2. The apparatus of claim 1, wherein the nut includes a sleeve portion disposed concentrically between the screw and the grommet.

3. The apparatus of claim 2, wherein the lip portion flares outwardly from the sleeve portion.

4. The apparatus of claim 1, wherein the shank portion is non-threaded.

5. The apparatus of claim 4, wherein the screw includes machine threads at its second end, and wherein the screw has zero in-the-helmet protrusion beyond the grommet.

6. The apparatus of claim 5, wherein the shank has a diameter S and diameter S is greater than the diameter of the thread crest of the screw.

7. The apparatus of claim 3, wherein the lip portion flare has a conic shape.

8. The apparatus of claim 1, wherein at least part of the lip portion extends slightly past the second end of the screw.

9. The apparatus of claim 8, wherein at least part of the lip portion extends slightly past an interior face of the grommet.

10. The apparatus of claim 8, wherein the lip portion that extends beyond the screw is adapted to receive a tool.

11. The apparatus of claim 3, wherein the flare allows for progressive deformation and energy dissipation as an eye of the grommet opens under a-force.

12. The apparatus of claim 1, wherein because diameter D>diameter B, the screw and nut are prevented from outwardly exiting the helmet.

13. The apparatus of claim 1, wherein the head of said screw includes an increased diameter that contacts the exterior of the helmet shell over an enlarged surface area.

14. The apparatus of claim 1, wherein said shank has a cross-sectional area A and said head has a cross-sectional area A, wherein A>4a.

15. The apparatus of claim 13, wherein said head directly contacts a surface of the shell, thereby directly transferring any ballistic energy delivered to said head on to the shell.

16. The apparatus of claim 14, wherein said screw includes a fillet portion at the juncture of said head and said shank that increases the screw's resistance to fracture.

17. The apparatus of claim 16, wherein said shank has a diameter d and said fillet has a radius f, wherein $0.1d<f<0.2d$.

18. An apparatus for mounting fitting equipment to a protective helmet shell having an interior, an exterior, and a bore extending through the helmet shell between the interior and the exterior, the apparatus comprising:

a fastener comprising:

a screw having:

a head at a first end thereof, a second end opposing the first end, and a shank portion which is adapted to extend through the bore, the bore having a diameter B; and a nut having a lip portion, the nut being connected to the screw at the second end thereof, the nut having a first portion having a diameter D and a second portion having a diameter d, the second portion being located between the first portion and the first end of the screw; and a grommet, the grommet being connected to the fitting equipment and located wholly external to the bore, the grommet having an inner diameter G;

wherein diameter D>inner diameter G>diameter d; and wherein diameter D>diameter B>diameter d.

* * * * *